US006780119B1

(12) United States Patent
Gankas

(10) Patent No.: US 6,780,119 B1
(45) Date of Patent: Aug. 24, 2004

(54) GOLF PUTTER ATTACHMENT

(76) Inventor: George M. Gankas, 128 Bardsdale St., Oxnard, CA (US) 93035

( * ) Notice: Subject to any disclaimer, the term of this patent is extended or adjusted under 35 U.S.C. 154(b) by 0 days.

(21) Appl. No.: 10/424,288

(22) Filed: Apr. 23, 2003

(51) Int. Cl.[7] ..... A63B 69/36
(52) U.S. Cl. ..... 473/236; 473/242; 473/251
(58) Field of Search ..... 473/330, 331, 473/236, 219, 237, 242, 231, 226, 251

(56) References Cited

U.S. PATENT DOCUMENTS

| | | | | | |
|---|---|---|---|---|---|
| 3,437,341 | A | * | 4/1969 | Hasten | 473/236 |
| 3,489,415 | A | | 1/1970 | Smith | |
| 3,989,257 | A | * | 11/1976 | Barr | 473/251 |
| 4,139,198 | A | | 2/1979 | Kanavas | |
| 4,222,566 | A | | 9/1980 | Berry, Jr. | |
| 4,323,246 | A | | 4/1982 | Nehrbas, Jr. | |
| 4,618,149 | A | * | 10/1986 | Maxel | 473/245 |
| 5,135,228 | A | | 8/1992 | Hawkins, Sr. et al. | |
| 5,240,253 | A | * | 8/1993 | Cooper | 473/236 |
| D353,178 | S | | 12/1994 | Koleoglon | |
| 5,382,019 | A | * | 1/1995 | Sneed | 473/304 |
| 5,467,538 | A | | 11/1995 | Chou et al. | |
| 5,478,078 | A | | 12/1995 | Lee | |
| 5,524,895 | A | | 6/1996 | Nakajima | |
| D380,799 | S | | 7/1997 | Arnold | |
| 5,718,644 | A | * | 2/1998 | Donofrio | 473/340 |
| 5,820,477 | A | | 10/1998 | Redkey et al. | |
| 5,961,392 | A | | 10/1999 | Hillock et al. | |
| 6,383,086 | B1 | | 5/2002 | Flood | |

* cited by examiner

*Primary Examiner*—Sebastiano Passaniti
(74) *Attorney, Agent, or Firm*—Jack C. Munro

(57) ABSTRACT

An attachment for the head of a golf putter which is to be used to train a golfer in making a precise smooth swing when striking of a golf ball in order to propel the golf ball directly to the target. The attachment comprises a rigid body which has an arcuate outer surface. The attachment is to be removably adhesively secured to the striking face of the golf putter. The arcuate surface of the attachment extends in an arc from a direction directly adjacent the toe of the head of a golf putter to a position directly adjacent the heel of the head of the golf putter.

2 Claims, 1 Drawing Sheet

GOLF PUTTER ATTACHMENT

BACKGROUND OF THE INVENTION

1. Field of the Invention

This invention relates to the game of golf and more particularly to a device that is to be attached to a golf putter than when used in practice when striking of a golf ball is intended to cause the precise striking more frequently of the golf ball in order to have the golf ball go straight to a target which typically will be a hole formed in a putting green.

2. Description of the Related Art

When a golfer plays a game of golf, the typical sequence of events is to drive a golf ball off a tee area to eventually land the golf ball on a putting green. Once on the putting green, the ball is to be putted by the golfer into a hole formed in the green. During an eighteen hole round of golf, it is common for a golfer to putt between thirty to forty times. The total score for the eighteen holes of golf may be no more between seventy to ninety strokes. Thus, thirty to fifty percent of the strokes in a round of golf are achieved by the use of the putter. If a golfer wishes to improve his or her score, because of the number of strokes that are being performed by the putter, if the number of putting strokes can be decreased, significant improvement can be achieved in playing of the game of golf.

Golfers normally spend a significant amount of time practicing their game. Golfers will spend hours and hours hitting balls in order to "groove the swing" which means to have the swing repeat precisely each and every time. This "grooving" of ones swing is also applicable to the putter. Golfers will go to great lengths to make sure that the putter head strikes the golf ball at precisely the same point each and every time the golf putter is propelled into a golf ball.

There have been all kinds of devices that could be used by a golfer to "groove" the putting swing. There have been devices that are laid on the putting green, such as a lineal piece of wood with the golfer then trying to move the putter and the swing precisely along that piece of wood before it strikes the golf ball. There have been constructed a practice putter which has a spherical head. The concept of this practice putter is excellent in that the spherical head must contact the golf ball at a precise point in order to propel the golf ball in a direction toward the target. If the spherical head is just the slightest degree off center when striking of the golf ball, the golf ball will be propelled in a deviated direction from the target. Because of the spherical surface of the spherical head, this deviation is accentuated so it can be readily apparent to the golfer that the golf ball was not struck precisely at the right point. One problem with the prior art practice putter is that it is a different putter and it can be only used at practice. It cannot be used when playing of a game. Each putter has its own weight and feel. A golfer likes to putt with his or her own particular putter and does not like to switch from one putter to another as usually best putting is achieved when a golfer uses only one putter and does not switch between different types of putters. However, if the concept of the spherical head practice putter could be somehow incorporated in conjunction with a golfer's own putter, it is believed a substantial improvement in a practice putting aid could be obtained.

In the past, there have been many attachments for the striking face of a golf putter. One such attachment comprises a prism-shaped device that is to be mounted on the striking face of the golf putter. Other such attachment for the striking face of a golf putter comprises a cup-shaped attachment.

Another such attachment uses an arcuate surface but the arc of the arcuate surface curves vertical and horizontal there is no arc as it is lineal. This means that the golf ball will be propelled directly to the target if it is struck anywhere along that lineal arcuate surface. This is not the best type of practice aid because it is desirable to groove the swing to repeat to a precise point, not to groove the swing to repeat anywhere along a line.

SUMMARY OF THE INVENTION

The first basic embodiment of the present invention is directed to an attachment for the striking face of a golf putter head which takes the form of a rigid body having an arcuate front surface and a planar back surface. The arcuate front surface has a center point which is intended to be the point of contact with a golf ball. The back surface is adapted to be mounted onto the planar striking face of a golf putter head. The arcuate front surface has a horizontal arc. Whereby the arcuate front surface is to be struck against the golf ball, and if the center point is the point of contact with the golf ball, the golf ball will be propelled straight to a target. When the arcuate front surface is struck against the golf ball at any point on the arcuate front surface except at the center point then the golf ball will be propelled in a direction away from the target.

A further embodiment of the present invention is where the first basic embodiment is modified by there being mounted an adhesive layer on the back surface of the attachment which permits ease of attaching, removing and securing of the attachment onto the striking face of the golf putter.

A further embodiment of the present invention is where the arcuate front face also includes a vertical arc.

A further embodiment of the present invention is where the just previous embodiment is modified by the horizontal arc having a first radius.

A further embodiment of the present invention is where the just previous embodiment is modified by the vertical arc having a second radius.

A further embodiment of the present invention is where the first radius is equal to the second radius which means that the arcuate front surface is spherical.

A further embodiment of the present invention is where the just previous embodiment is modified by the spherical front surface being spherically in size substantially equal to the diameter of a conventional golf club.

A second basic embodiment of the present invention is defined as an attachment which is to be mounted in combination with a golf putter where the golf putter has a head which is attached to an elongated handle. The head has a planar striking face which is to be normally used to strike against the golf ball. The planar striking face has a heel located directly adjacent the handle and a toe located furthest from the handle. The attachment has a rigid body which has an arcuate front surface and a planar back surface. The arcuate front surface has a center point which is intended to be the point of contact with a golf ball. The back surface is to be secured by a securement to the planar striking face. The arcuate front surface comprises a horizontal arc that extends from directly adjacent the heel to directly adjacent the toe of the planar striking face. Whereby the arcuate front surface is to be struck against the golf ball, and if the center point is the point of contact with the golf ball, the golf ball will be propelled straight to a target. Whereby when the arcuate front surface is struck against the golf ball at any point on the arcuate front surface except the center point is the point of contact with the golf ball, then the golf ball will be propelled in a direction away from the target.

A further embodiment of the present invention is where the second basic embodiment is modified by there being included an adhesive layer on the planar back surface of the rigid body with this adhesive layer permitting ease of attaching, removing and securing of the attachment to the planar striking surface.

A further embodiment of the present invention is where the second basic embodiment is modified by the arcuate front surface including a vertical arc.

A further embodiment of the present invention is where the just previous embodiment is modified by the horizontal arc having a first radius.

A further embodiment of the present invention is where the just previous embodiment is modified by the vertical arc having a second radius.

A further embodiment of the present invention is where the just previous embodiment is modified by the first radius being equal to the second radius which means that the arcuate front surface is spherical.

A further embodiment of the present invention is where the just previous embodiment is modified by the said spherical front surface being approximately equal to the spherical size of a conventional golf ball.

BRIEF DESCRIPTION OF THE DRAWING

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
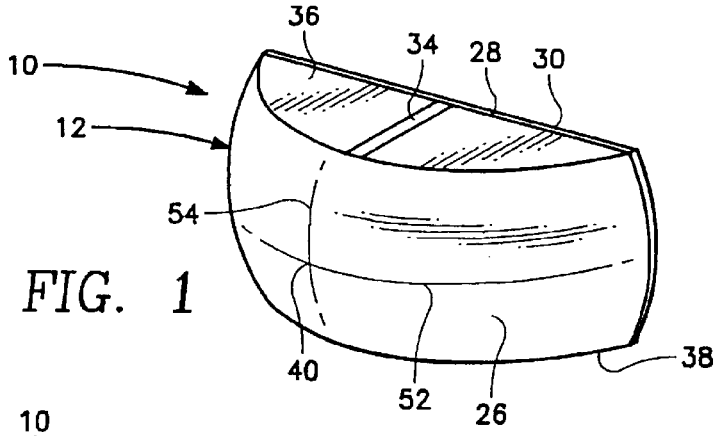
FIG. 1 is a frontal isometric view of the attachment that is to be used in conjunction with the head of a golf putter.

Referring particularly to the drawing, there is shown the attachment 10 of this invention. Attachment 10 is constructed of a rigid body 12 which generally will be constructed of a light material, such as a plastic or aluminum. The body 12 is going to be mounted onto the striking face 14 of a head 16 of a golf putter 18. The head 16 has a toe 20 and a heel 22. An elongated handle 24 is attached to the head 16 at the heel 22: It is desirable for the body 12 to be as light as possible so as to not significantly affect the overall weight of the golf putter 18 with the attachment 10 attached thereto. Golfers get accustomed to a certain weight for their putter and any significant increase in weight can affect the putting ability of the golfer. The use of the attachment 10 will not affect the overall weight of the golf putter 18.

The body 12 has a front face 26 and a back face 28. The back face 28 is planar and has mounted thereon an adhesive layer 30. The adhesive layer 30 is to permit installation, removing and resecuring of the attachment 10 on the striking face 14. Typically, on most putter heads 16 there is inscribed a center line 32. The attachment 10 is intended to be centered relative to this center line 32 with its longitudinal dimension extending between the toe 20 and the heel 22. To facilitate this alignment, there will be inscribed a center line 34 on the planar top surface 36 of the body 12. There is to be a similarly shaped planar bottom surface 38 on the opposite side of the body 12. The top surface 36 is parallel to the bottom surface 38. It is to be understood that the attachment 10 can be mounted in any placement on the striking face 14. However, the preferable installation position is with the center lines 32 and 34 being in alignment.

The material for the adhesive layer 30 can comprise any one of several conventional types of adhesive. Typically, the adhesive is to be a low force adhesive that will permit the attachment 10 to be mounted onto the striking face 14 but at the same time permit easy manual removal and reinstallation several times. When the adhesive layer 30 loses its adhesiveness, the layer 30 can be replaced with a new adhesive layer.

Figure 2:
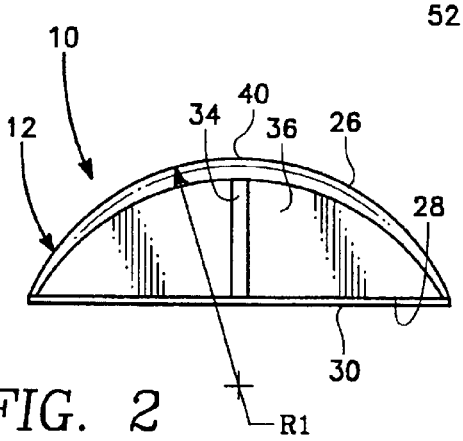
FIG. 2 is a top plan view of the attachment of FIG. 1 showing the radius of the horizontal arc of the arcuate front surface of the attachment.
Figure 3:
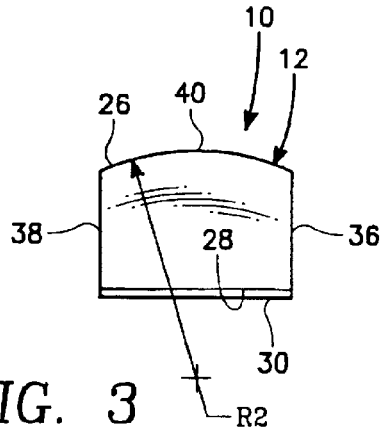
FIG. 3 is a side view of the attachment of FIG. 1 showing the radius of curvature for the vertical arc of the attachment.
Figure 4:
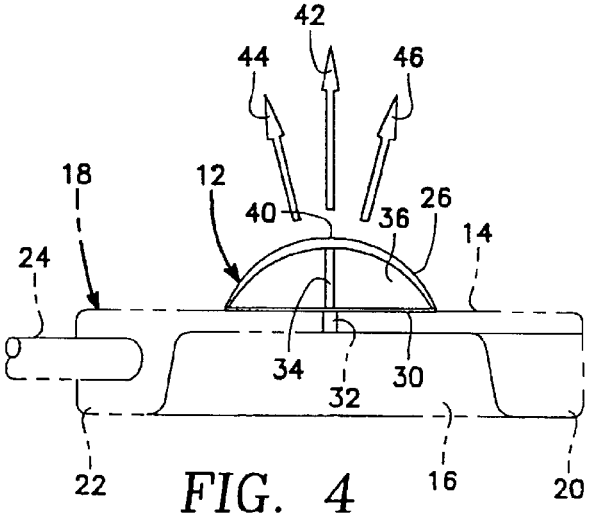
FIG. 4 is a view showing the attachment being mounted onto the striking face of a golf putter head with the attachment typifying the direction of movement of a golf ball by a series of arrows with one arrow indicating direction of movement of the golf ball to the target and other arrows indicating direction of movement deviating from the target.

The front surface 26 is arcuate and actually longitudinally is part of a circle with the radius R1, which is shown in FIG. 2. The radius R1 establishes the horizontal arc of the front face 26. The front face 26 also has a vertical arc which is defined by radius R2 shown in FIG. 3. R1 happens to be equal to R2. This means that the entire front face 26 is actually a part of a sphere.

The size of the radiuses R1 and R2 each will normally equal 0.812 inches. The radius of a conventional golf ball happens to be equal to about that same size. However, minor deviation from 0.812 inches would be satisfactory, such as between 0.7 inches to 0.9 inches. It has been found that if R1 was really much larger and the horizontal arc of the front face 26 was shallow, that when the front face 26 comes into contact with the golf ball, and the golf ball was not struck at the center point 40, this means that the golf ball will be propelled at an unpronounced deviated direction toward the target. It is desirable to immediately make known to the user that the golf ball is deviating. Using the same diameter of the front face as a golf ball produces this result.

Figure 5:
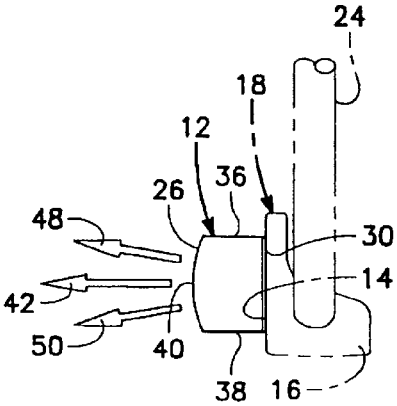
FIG. 5 is a side view showing the attachment mounted onto a golf putter head and again depicting, by a series of arrows, the striking of the golf ball to either direct the golf ball directly to the target or have the golf ball to be deviated from the direction of the target.

The target typically will be a hole defined as a cup in a putting green but may also comprise a container if one is practicing putting on a carpet or could even comprise an inscribed area on either a putting green or a carpet. The utilizing of the radius R1 that equals the radius of the golf ball produces a readily apparent deviation anytime the golf ball is struck that is not struck on the center point 40. The center point 40 directs a golf ball in the direction of arrow 42. This is the desired direction toward the target. Any slight miss-hitting of the front face on the golf ball will produce the golf ball moving in the direction, for example, in the direction of arrows 44 and 46 which deviate significantly from the direction of arrow 42 even though the front face 26 strikes the golf ball only a short distance away from the center point 40. Also, if the golf putter 18 is twisted slightly when striking of the golf ball, the golf ball can be propelled in a slightly upward direction as represented by arrow 48 or in a slightly downward direction as represented by arrow 50 in FIG. 5. It is always desirable that the golf ball be struck along line 52 so as to direct the golf ball level with the ground and not have a tendency to direct the golf ball toward the ground, represented by arrow 50, or to cause the golf ball to hop, as represented by arrow 48. It is also desirable that the golf ball be struck along vertical line 54, as indicated in FIG. 1. The intersection of lines 52 and 54 is at the center point 40.

If the radius R2 was significantly elongated, similar as to what was previously discussed in relation to radius R1, the same problem would occur in that the deviations would be made smaller when striking of the golf ball and therefore be not as readily apparent. It is important to make the deviations easily and quickly observable when a user is putting with the attachment 10 of this invention, so as to call attention to the user that not a precise contact with the golf ball was obtained.

If the radiuses R1 and R2 were made small, such as what might be found in a marble, it would be very difficult for the user to be able to obtain contact precisely at the center point 40. Even the smallest deviation would result in a deviation of the golf ball during the making of a putt. Most putts are made ten feet, twenty feet, thirty feet in length. If one is practicing putting at twenty feet, it doesn't take much of a deviation to move the golf ball sufficiently so that it will not connect with the target. If the radiuses R1 and R2 were significantly small and the result that the sphere that is produced on the front face 26 was also small, it would just be impossible to obtain a precise directed putt to the target. That is why is has been found that with radiuses R1 and R2 to be equal to about the size of the radius of a golf ball that the optimum size is obtained. Using of this spherical size, the deviation of the golf ball in a ten to twenty foot putt is readily apparent, but at the same time the user is able, if striking the golf ball correctly, to direct the golf ball directly to the target.

What is claimed is:

1. In combination with a golf putter which has a head attached to an elongated handle, said head having a planar striking face which is to be normally used to strike against a golf ball, said planar striking face having a heel located directly adjacent said handle and a toe located furthest from said handle, an attachment for said golf putter comprising:

a rigid body having a spherical front surface and a planar back surface, said spherical front surface having a center point which is to be intended to be a point of contact with a golf ball, said back surface to be secured by a securement to said planar striking face, said spherical front surface is to be struck against a golf ball and if said center point is the point of contact with the golf ball the golf ball will be propelled straight to a target, when said spherical front surface is struck against the golf ball at any point on said spherical front surface except at said center point then the golf ball will be propelled in a direction away from the target;

said spherical front surface includes a horizontal arc that extends from directly adjacent the heel to directly adjacent the toe; and said attachment having a planar top surface and a planar bottom surface, said planar top surface being parallel to said planar bottom surface, said planar top surface having an inscribed center line, said center line facilitating correct center mounting on said head by proving a center line that is to be aligned with a middle point of said head.

2. The combination as defined in claim 1 wherein:

said spherical front surface being spherically in size substantially equal to the diameter of a golf ball.

* * * * *